US012760900B2

(12) United States Patent
Song

(10) Patent No.: US 12,760,900 B2
(45) Date of Patent: Oct. 13, 2026

(54) WOOD PELLET FURNACE FIREBOX

(71) Applicant: RECTEQ, LLC, Sandy Springs, GA (US)

(72) Inventor: Binglu Song, Jinhua (CN)

(73) Assignee: RECTEQ, LLC, Sandy Springs, GA (US)

( * ) Notice: Subject to any disclaimer, the term of this patent is extended or adjusted under 35 U.S.C. 154(b) by 566 days.

(21) Appl. No.: 18/260,774

(22) PCT Filed: Mar. 25, 2021

(86) PCT No.: PCT/CN2021/082898
§ 371 (c)(1),
(2) Date: Jul. 7, 2023

(87) PCT Pub. No.: WO2022/147907
PCT Pub. Date: Jul. 14, 2022

(65) Prior Publication Data

US 2024/0302045 A1 Sep. 12, 2024

(30) Foreign Application Priority Data

Jan. 11, 2021 (CN) ..... 202110032772.3

(51) Int. Cl.
*F24B 1/195* (2006.01)
*F24B 1/191* (2006.01)

(52) U.S. Cl.
CPC ..... *F24B 1/195* (2013.01); *F24B 1/1915* (2013.01)

(58) Field of Classification Search
CPC ..... F24B 1/195; F24B 1/024; F24B 13/006; F23C 1/16; F23C 1/24; F23C 1/38; F23C 1/1915; F23C 1/195
USPC ..... 126/500, 73, 176 R, 242–243, 501; 431/195, 200, 201
See application file for complete search history.

(56) References Cited

U.S. PATENT DOCUMENTS 575,487 A * 1/1897 May ..... F23H 9/08 126/177
2,996,143 A * 8/1961 Beasley ..... F23G 7/065 60/298

(Continued)

FOREIGN PATENT DOCUMENTS

CN 202253599 U 5/2012
CN 103900112 A * 7/2014

(Continued)

OTHER PUBLICATIONS

International Preliminary Report on Patentability received for PCT Patent Application No. PCT/CN2021/082898, mailed on Jul. 20, 2023, 9 pages (5 pages of English Translation and 4 pages of Original Document).

(Continued)

*Primary Examiner* — Vivek K Shirsat
(74) *Attorney, Agent, or Firm* — Womble Bond Dickinson (US) LLP

(57) ABSTRACT

Disclosed is a novel wood pellet furnace firebox. The firebox comprises a firebox wall and a firebox bottom plate, wherein the firebox wall is provided with a hollow interlayer air duct, the outer wall of the firebox is provided with an air outlet which communicates with the interlayer air duct, and the bottom and top parts of the inner wall of the firebox are respectively provided with a bottom air intake hole and a top air intake hole which communicate with the interlayer air duct. By means of the arrangement of the firebox wall as a hollow interlayer structure, the present application allows a portion of air entering the interlayer air duct to enter from the bottom air intake hole and mix with ignited wood pellets for primary combustion, and another portion of air to be preheated by means of the interlayer air duct, then blow out from the top air intake hole and mix with red-hot flue gas and dust from the primary combustion for secondary combus- (Continued)

tion. The secondary combustion can increase the roasting temperature in a furnace chamber to above 800 degrees Fahrenheit, and on the other hand, can also burn up flue gas and dust as much as possible to greatly improve cleanliness in a furnace hearth, and increase the combustion efficiency and fuel utilization rate, which highlights the advantages of wood pellet furnaces with regards to saving energy and protecting the environment.

13 Claims, 9 Drawing Sheets

(56) References Cited

U.S. PATENT DOCUMENTS 4,836,115 A * 6/1989 MacArthur ..... F23B 1/36 110/118
8,336,537 B1 12/2012 Peters, Jr.

FOREIGN PATENT DOCUMENTS

| | | | |
|---|---|---|---|
| CN | 104421968 | A | 3/2015 |
| CN | 105716122 | A | 6/2016 |
| CN | 108224479 | A | 6/2018 |
| CN | 112781074 | A | 5/2021 |
| CN | 214370367 | U | 10/2021 |
| KR | 10-2016-0088104 | A | 7/2016 |
| WO | 2022/147907 | A1 | 7/2022 |

OTHER PUBLICATIONS

International Search Report and Written Opinion received for PCT Patent Application No. PCT/CN2021/082898, mailed on Sep. 6, 2021, 11 pages (5 pages of English Translation and 6 pages of Original Document).

* cited by examiner

WOOD PELLET FURNACE FIREBOX

FIELD OF THE DISCLOSURE

The present application belongs to the technical field of fireboxes for wood pellet furnaces (including food ovens and heating furnaces), and in particular, relates to a new wood pellet furnace firebox.

BACKGROUND

With the increasing use of wood pellet furnaces (including food ovens and heating furnaces) on the market, it is increasingly pursuing thermal efficiency during use, high environmental cleanliness, and convenience for cleaning residues after combustion.

However, the core component of the traditional wood pellet furnace is a firebox that is basically a single-walled barrel-shaped cylinder with a top opening. Wood pellets and air are mixed and burning at the bottom of the cylinder. Since it can only achieve a single incomplete combustion, more smoke and dust will be generated, resulting in pollution and fuel waste, which is not conducive to the environmental goals of cleanliness, energy conservation and emission reduction.

SUMMARY OF THE DISCLOSURE

Aiming at the problems existing in the prior art, the present application provides a novel wood pellet furnace firebox.

A novel wood pellet furnace firebox, comprises: a firebox wall and a firebox bottom plate, wherein said firebox wall is provided with a hollow interlayer air duct: outer wall of the firebox (outer lateral wall of the firebox wall) is provided with an air outlet communicated with the interlayer air duct, and the bottom and the top of the inner wall of the firebox (inner lateral wall of the firebox wall) are respectively provided with bottom air intake holes and top air intake holes communicated with the interlayer air duct. By means of the arrangement of the firebox wall as a hollow interlayer structure, the present application allows a part of air entering the interlayer air duct to blow out from the bottom air intake holes to be mixed with ignited wood pellets for primary combustion, and the other part of air preheated by means of the interlayer air duct then to blow out from the top air intake holes and mix with hot flue gas and dust from the primary combustion for secondary combustion. On one hand, the secondary combustion can raise the roasting temperature in the furnace chamber to more than 800 degrees Fahrenheit due to multiple times of combustion; and, on the other hand, can burn up flue gas and dust as much as possible to greatly improve cleanliness in a furnace hearth, which undoubtedly greatly improves the combustion efficiency and utilization rate of fuel that highlights the advantages of wood pellet furnaces with regards to energy-saving and environmental protection.

As a further improved embodiment, the inner wall of said top air intake holes are processed into a shape of upwardly guided semicircle to facilitate the upward blowing of preheated air, increase the height of the flame, and thereby increase the temperature above the firebox.

As a further improved embodiment, an air guide vane is spirally provided in said interlayer air duct, and both sides of the air guide vane are sealed to the wall surfaces of the interlayer air duct, thereby dividing the interlayer air duct into a spiral ventilation duct. The means of providing an air guide vane in the interlayer air duct can prolong the flow time of air in the interlayer air duct, further preheat the air, and increase the temperature above the firebox.

As a further improved embodiment, said firebox bottom plate includes a fixed part and a movable part, in which the fixed part and the movable part are rotatably mounted, and the fixed part is fixedly mounted on the inner wall of the firebox: a rotating shaft located outside the firebox passes through the firebox wall and is connected with said movable part, where the movable part is turned between 0-90° by rotating the rotating shaft. The firebox bottom plate, as for carrying wood burning, is arranged in a rotatable mounting form of the fixed part and the movable part, which, besides the carrying function of wood burning, can also discharge the ashes out of the firebox by rotating the movable part. It saves the time and effort for disassembling the fire cover and drip pan on the firebox and cleaning the same in the traditional cleaning process.

As a further improved embodiment, said rotating shaft is connected with a handle, or said rotating shaft is connected with a motor and driven by the motor. Turning the handle or driving the rotating shaft by the motor saves time and effort and can meet the different needs of users.

As a further improved embodiment, said fixed part is a circular sheet structure or a circular ring structure, and the movable part is fitted in the fixed part and is rotatably connected with the fixed part.

As a further improved embodiment, said firebox wall is connected with an auger tube feeder, the auger tube feeder has a feed port, and the feeding motor can transport charcoal or wood to the firebox bottom plate through the feed port. By means of the auger tube feeder, charcoal or wood can be transported to the firebox bottom plate, which can meet users' needs to fill the firebox at a long distance, saving both time and effort.

As a further improved embodiment, a detachable ash box is placed under said firebox bottom plate.

As a further improved embodiment, said ash box is in a shape of cylinder or square drawer.

As a further improved embodiment, an auger box is provided outside the auger tube feeder located between the feed port and the firebox in a sealed manner, and the auger box is hollow structure with two ends open: one end of the auger box is sealed with the air outlet on the firebox wall, and the other end of the auger box is sealed with the air supply fan. The auger tube feeder is mounted in the auger box, and air can be remotely transported to the firebox by the air supply fan and the auger box, which also increases the flexibility of assembly and maintenance.

The following is further explanation of the present application:

The present invention aims to make a subversive transformation of the firebox for the traditional wood pellet furnace to achieve this goal and add the use of charcoal or wood as fuel.

First of all, the special design of the firebox wall of the present invention has the characteristics of secondary combustion. The firebox is a circular, elliptical, square or other polygonal cylinder, and the firebox wall is hollow, acting as an interlayer air duct (the firebox wall is a double-layer structure, where the two ends of the firebox wall are closed while the middle is hollow, and the interlayer of the hollow part is used for air circulation). There are air intake holes provided at the bottom and top of the inner wall of the firebox. The shape and arrangement of the air intake holes are diverse. The fresh air generated by the air supply fan from the auger box to the firebox partly blows out from the bottom air intake holes of the firebox and is mixed with the ignited wood pellets for primary combustion. The other part of the air is preheated by the interlayer air duct of the spiral guide vane on the firebox wall, blown out from the top air outlet holes and mixed with hot flue gas and dust after the primary combustion for secondary combustion. On one hand, the secondary combustion can raise the roasting temperature in the furnace chamber to over 800 degrees Fahrenheit due to multiple times of combustion; and, on the other hand, can burn up flue gas and dust as much as possible to greatly improve cleanliness in a furnace hearth, which undoubtedly greatly improve the combustion efficiency and utilization rate of fuel that highlights the advantages of wood pellet furnaces with regards to energy-saving and environmental protection. Moreover, by controlling the air supply fan to adjust supply air rate and further flexibly control the combustion conditions, the degree of smoke can be controlled to meet differentiated requirements for the flavor upon the degree of smoke. Secondly, the bottom of the firebox of the present invention is specially designed to easily remove the ashes remaining on the firebox bottom plate after combustion. The firebox bottom plate is composed of a fixed part and a movable part. The movable part is usually in a horizontal state. When dumping the ashes, the movable part can be manually or electrically driven to rotate at 90° to become a vertical state by a manual handle or a motor at the end cover extended from the rotating shaft. At this time, the ashes on the bottom plate can be smoothly poured into the ash box at the bottom of the firebox (cylindrical freestanding or square drawer-shaped) under the action of gravity, and then the bottom plate will be restored to the common horizontal state. Later, the ash box can be taken out to remove the ash and then put back to the bottom of the firebox. This eliminates the time and effort for disassembling the fire cover and drip the pan on the firebox and cleaning the same in traditional dust removal. Finally, the present invention provides a special adapter box for connecting the firebox with the auger tube. While air and material supply for the secondary combustion are successfully achieved, the flexibility of assembly and maintenance is also increased, and the firebox itself or its bottom plate can be separately replaced. A manhole 9 is added at the bottom of the auger tube near the bottom of the adapter box to facilitate maintenance or replacement of the ignition rod.

Reference signs: 1—firebox, 2—firebox wall, 3—auger box, 4—bottom air intake hole, 5—top air intake hole, 6—firebox bottom plate, 7—ash box, 8—adapter box, 9—manhole, 10—ignition rod, 11—interlayer air duct, 12—rotating shaft, 13—handle, 14—auger tube feeder, 15—feed port, 16—servo motor, 17—fixed part, 18—movable part, 19—feeding motor, 20—air supply fan, 21—guide vane, 22—auger, 23—air outlet.

DETAILED DESCRIPTION

The present application will be further explained below in conjunction with the drawings.

Example 1

Figure 1:
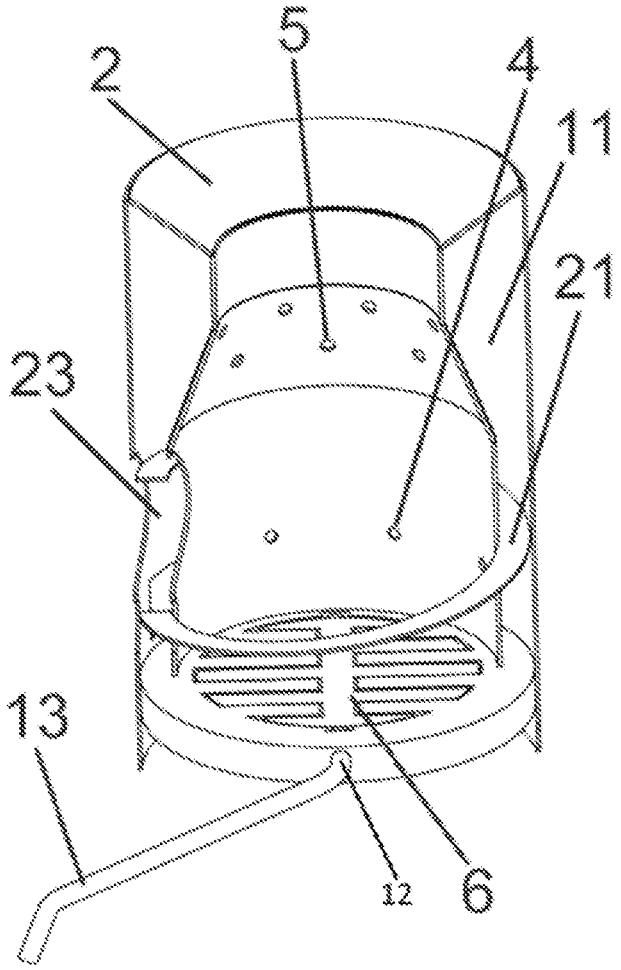
FIG. 1 is a semi-sectional schematic view 1 of the firebox of the present application.

A firebox 1, comprises a firebox wall 2 and a firebox bottom plate 6 installed at the bottom of the firebox. Said firebox wall has a hollow interlayer air duct 11 (the firebox wall is a double-layer structure, and both ends of the firebox wall are closed while the middle is hollow; and the interlayer of the hollow part is used for airflow), and the bottom and top of the inner wall of the firebox (inner lateral wall of the firebox wall) are respectively provided with bottom air intake holes 4 and top air intake holes 5 communicated with the interlayer air duct 11, as shown in FIG. 1. It can be seen from FIG. 1 that the firebox bottom plate 6 is arranged at the bottom of the firebox, and the bottom air intake holes 4 are located above the firebox bottom plate 6. The outer wall of the firebox (outer lateral wall of the firebox wall) may be provided with an air outlet 23 communicated with the interlayer air duct 11 according to common knowledge. Air outlet 23 is connected to the air supply fan 20, and the air supply fan 20 delivers air to the interlayer air duct 11 through the air outlet. After the air enters the interlayer air duct 11 on the firebox wall, a part of the air enters the firebox from the bottom air intake holes 4 of the firebox and is mixed with the wood pellets ignited on the firebox bottom plate for primary combustion, and the other part of the air is preheated by the interlayer air duct on the firebox wall, blows out from the top air intake holes 5 and is mixed with the hot flue gas and dust after primary combustion for secondary combustion. On one hand, the secondary combustion can raise the roasting temperature in the furnace chamber to more than 800 degrees Fahrenheit due to multiple times of combustion; and, on the other hand, can burn up flue gas and dust as much as possible to greatly improve cleanliness in a furnace hearth, which improves the combustion efficiency and utilization rate of fuel, and further highlights the energy-saving and environmental protection advantages of wood pellet furnaces.

Said firebox wall is also connected with the auger tube feeder 14. The output end of the auger tube feeder 14 is located above the firebox bottom plate 6, and the input end of the auger tube feeder is also provided with a feed port 15. The feeding motor 19 can transport charcoal or wood pellets as fuel to the firebox bottom plate through the feed port 15, and the charcoal or wood on the firebox bottom plate is ignited by the ignition rod 10.

Figure 2:
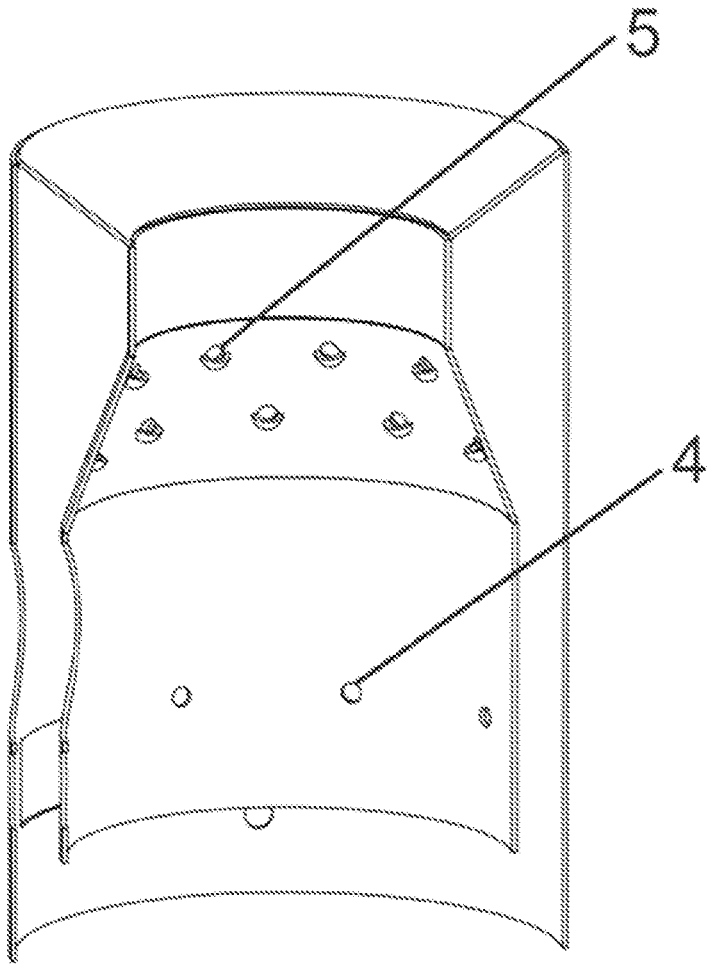
FIG. 2 is a semi-sectional schematic view 2 of the firebox wall of the present application.

In one embodiment, in order to increase the temperature above the firebox, the inner walls of the top air intake holes 5 are made into an upwardly guided semicircular shape, as shown in FIG. 2. The air entering into the interlayer air duct 11 is preheated first, then discharged from the top air intake holes 5, and the preheated air is blown upward to increase the height of the flame, thereby further increasing the temperature above the firebox. In the meantime, an air guide vane 21 (i.e., guide vane) is mounted in the interlayer air duct 11. The guide vane 21 is provided in the interlayer air duct in a spiral shape, and both sides of the guide vane 21 are sealed to the wall surfaces of the interlayer air duct 11, which divides the interlayer air duct into a spiral ventilation duct. The air outlet 23 on the firebox wall is opened at the lower part of the spiral ventilation duct, which prolongs the circulation time of air in the interlayer duct, thereby further allowing air entering into the spiral flow-guide of the interlayer duct to be preheated and discharged from the top air intake holes 5 to increase the temperature above the firebox.

Figure 3:
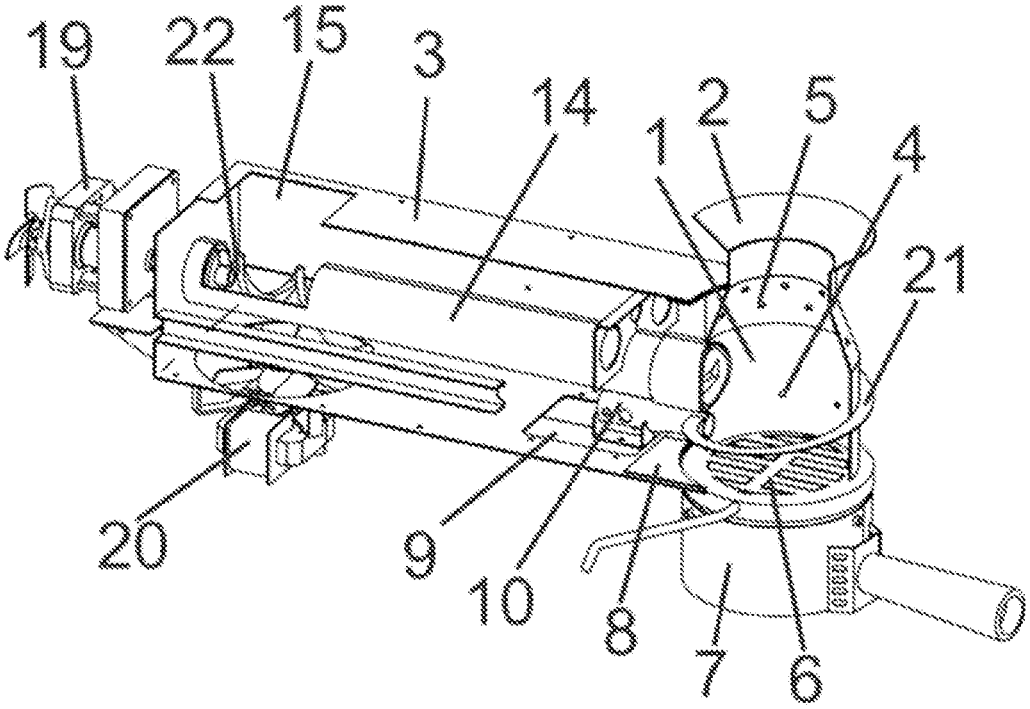
FIG. 3 is a semi-sectional schematic view 1 of the firebox and accessory devices of the present application.
Figure 4:
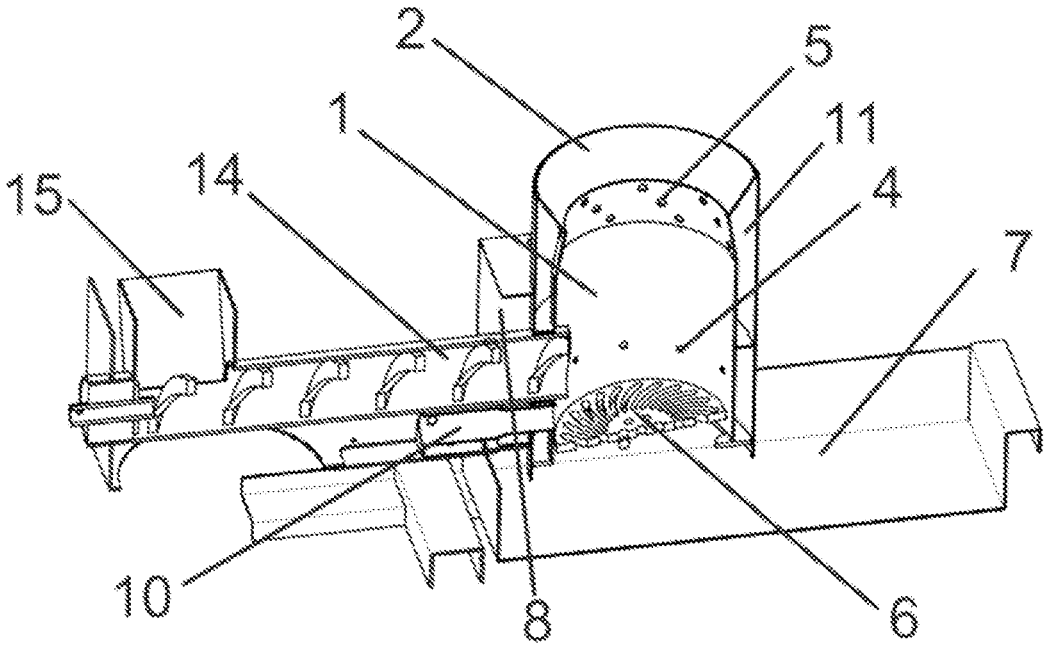
FIG. 4 is a semi-sectional schematic view 2 of the firebox and accessory devices of the present application.

In one embodiment, in order to facilitate the air supply, a hollow and sealed auger box 3 is arranged outside the firebox. One end of the auger box is sealed to the air outlet on the firebox wall, and the other end is sealed to the air supply fan. Furthermore, in order to increase the flexibility of assembly and maintenance, the auger tube feeder 14 located in the rear half of the feed port 15 is sealed and mounted in the auger box 3, or an adapter box 8 can be mounted between the auger box 3 and the firebox 1. As shown in FIG. 3, a special adapter box 8 connects the firebox of the application and the auger box, and adapter box 8 connects the auger box 3 to the firebox 1. While air and material supply for the secondary combustion are successfully achieved, the flexibility of assembly and maintenance is also increased, and the firebox itself or its bottom plate can be separately replaced. A manhole 9 is added at the bottom of the auger tube near the bottom of the adapter box to facilitate maintenance or replacement of the ignition rod 10. At this point, the air is introduced into the firebox wall through the auger box 3. A part of the air enters the firebox from the bottom air intake holes 4 and is mixed with the ignited wood pellets for primary combustion, and the other part of the air is preheated by the interlayer air duct on the firebox wall, blows out from the top air intake holes 5 and is mixed with the hot flue gas and dust after primary combustion for secondary combustion.

Figure 8:
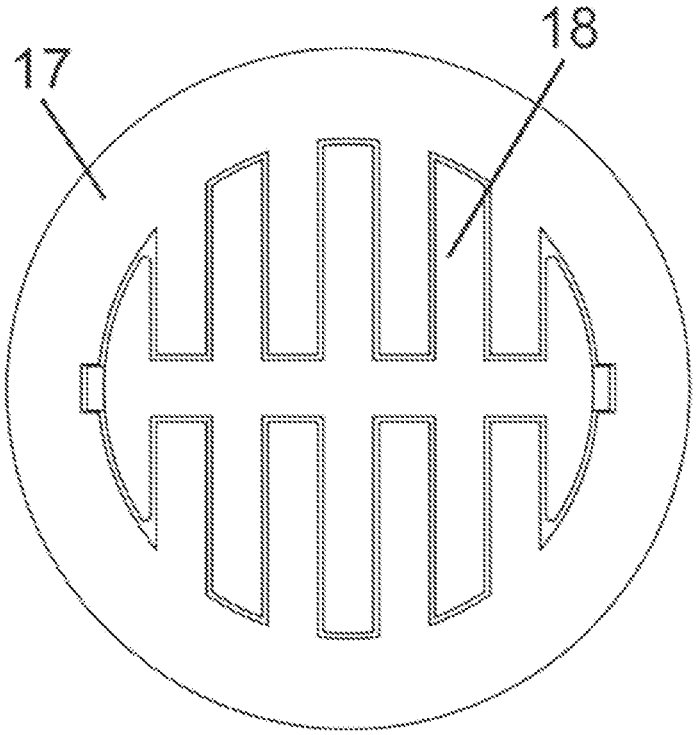
FIG. 8 is a schematic structural view 1 of the firebox bottom plate.
Figure 9:
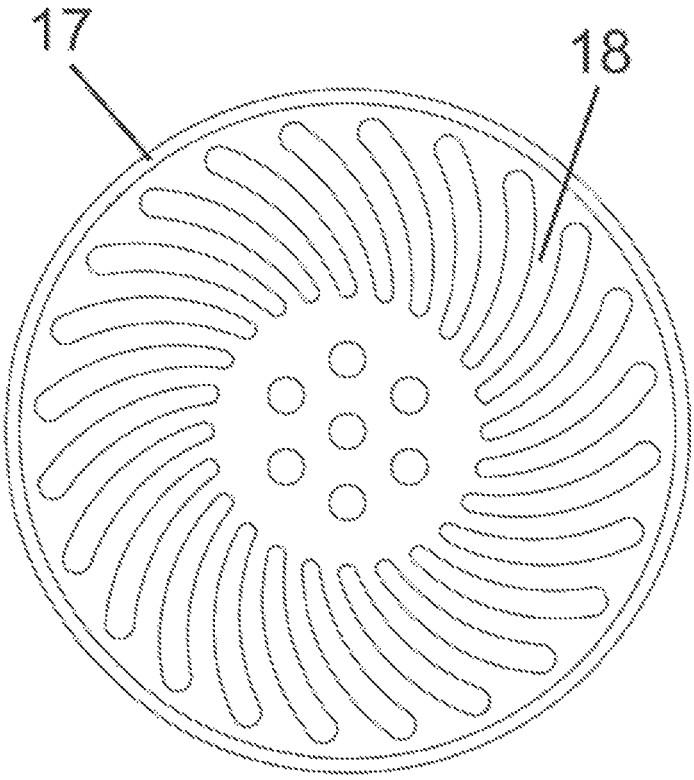
FIG. 9 is a schematic structural view 2 of the firebox bottom plate.
Figure 10:
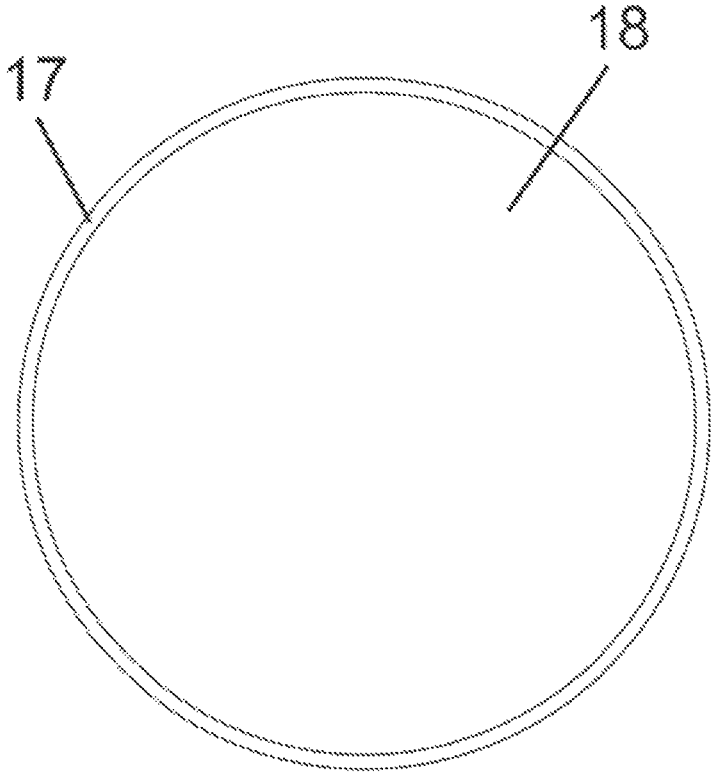
FIG. 10 is a schematic structural view 3 of the firebox bottom plate.

In one embodiment, in order to facilitate the removal of ashes remaining on the firebox bottom plate 6 after combustion, said firebox bottom plate 6 includes a fixed part 17 and a movable part 18. The movable part 18 is mounted inside the fixed part 17 and the movable part 18 and the fixed part 17 are rotatably mounted. When the fixed part 17 and the movable part 18 are in the same horizontal plane, the gap between the fixed part 17 and the movable part 18 is the smallest. For example, the gap can only be left for the movable part 18 to rotate on the fixed part 17. In addition, the fixed part 17 and the movable part 18 can be deformed in a variety of ways. For example, as shown in FIG. 8, the fixed part 17 and the movable part 18 can have a sheet-like structure with a number of connected openings. Correspondingly, a compatible movable part 18 is mounted in the openings of the fixed part. As shown in FIGS. 9 and 10, the fixed part 17 can be a ring structure, and a sheet-shaped movable part 18 is rotatably mounted on the fixed part 17, and the firebox bottom plate can be made into a hollow-out pattern, so that a part of loose and fine ashes can fall into the ash box without rotating the bottom plate at ordinary times to achieve the purpose of pre-partial dust removal, as shown in FIG. 9.

The rotating shaft 12 outside the firebox 1 passes through the firebox wall and is connected with the movable part 18, and the movable part is usually in a horizontal state. In order to collect ashes, an ash box 7 is placed under the firebox bottom plate 6. The ash box 7 can be made into diverse structures. For example, the ash box with a fixed handle can be directly placed under the firebox bottom plate 6, and the shape of the ash box is fitted to the shape of the firebox and is cylindrical, as shown in FIG. 3: the ash box 7 can also be an open cuboid structure, as shown in FIGS. 4-7. When the ashes need to be dumped, the ashes on the firebox bottom plate 6 can be dumped into the ash box 7 by directly rotating the rotating shaft 12.

Figure 5:
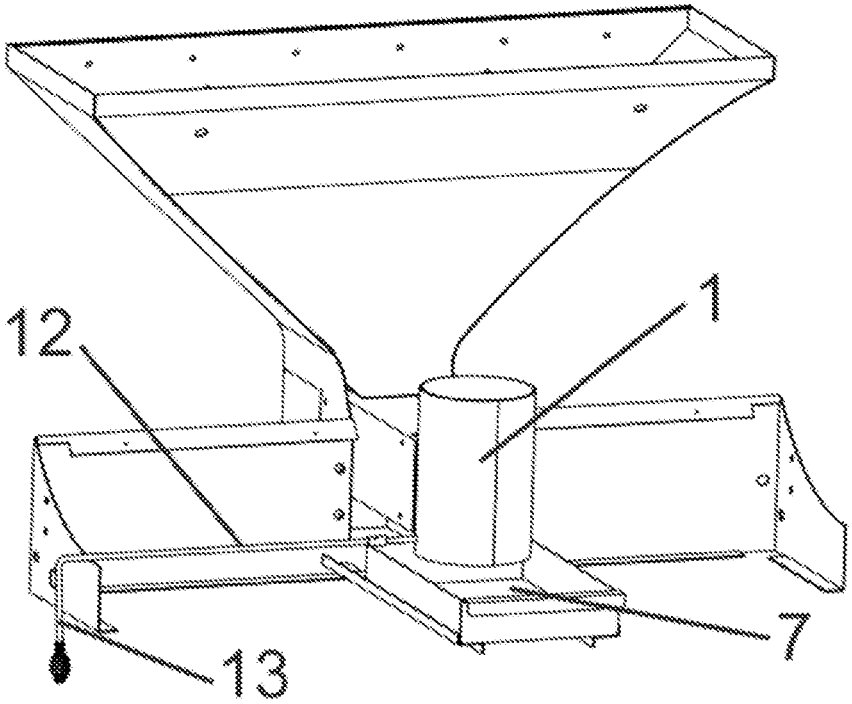
FIG. 5 is a schematic structural view 1 of Example 1 of the present application.
Figure 6:
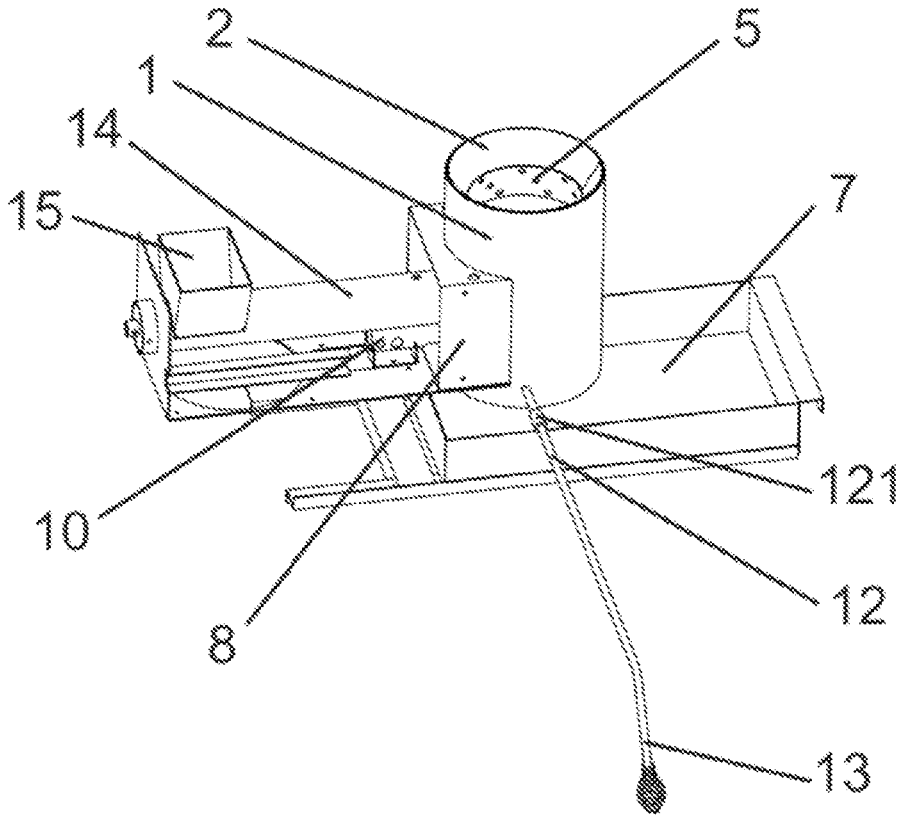
FIG. 6 is a schematic structural view 2 of Example 1 of the present application.
Figure 7:
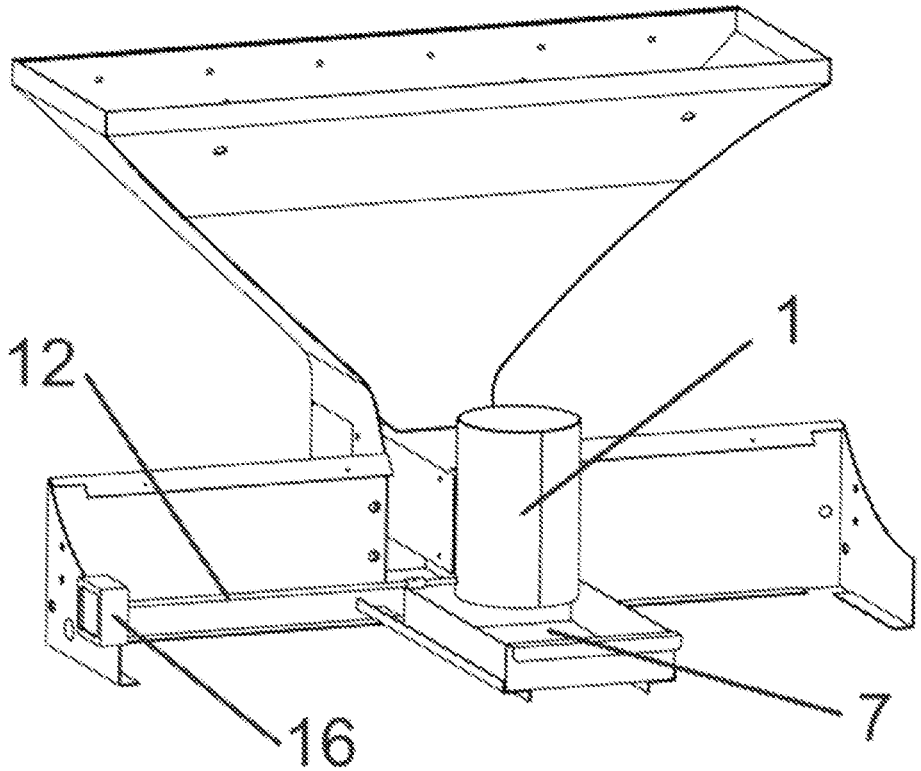
FIG. 7 is a schematic structural view 1 of Example 2 of the present application.

Further, in order to facilitate the rotation of the rotating shaft, for example, as shown in FIG. 6, a detachable adapter 121 can be provided at the free end of the rotating shaft. The adapter 121 can be connected to the elongated handle 13, the movable part 18 can be turned over by turning the handle 13: or the rotating shaft 12 can be directly connected with the handle 13 into a whole, as shown in FIG. 1: for another example, the rotating shaft 12 can be processed into a telescopic structure and the free end of the rotating shaft 12 is equipped with a handle 13; when not in use, the rotating shaft 12 is retracted to the shortest state. When needed, the rotating shaft 12 can be extended, as shown in FIGS. 5 and 6, which manually drives the movable part 18 to rotate 90° into a vertical state. At this point, the ashes on the firebox bottom plate can be smoothly poured into the ash box 7 at the bottom of the firebox under the action of gravity, and then the bottom plate is restored to the common horizontal state. Later, the ash box can be taken out to remove the ashes and then replaced at the bottom of the firebox. It saves the time and effort for disassembling the fire cover and drip pan on the firebox and cleaning the same in the traditional cleaning process.

Example 2

Example 2 is generally the same as Example 1. The difference is that the rotating shaft 12 can be driven by a motor 16, instead of manual rotation. The free end of the rotating shaft 12 is connected to the servo motor 16. After the movable part of the firebox bottom plate is electrically driven by the servo motor 16 through the rotating shaft 12 to rotate 90° into a vertical state, the ashes on the firebox bottom plate can be smoothly poured into the ash box 7 at the bottom of the firebox under the action of gravity, and then the bottom plate is restored to the common horizontal state. Later, the ash box can be taken out to remove the ashes and then put back into the bottom of the firebox. It saves the time and effort for disassembling the fire cover and drip pan on the firebox and cleaning the same in the traditional cleaning process.

The invention claimed is:

1. A novel wood pellet furnace firebox, comprising:

a firebox wall and a firebox bottom plate, wherein the firebox wall is provided with a hollow interlayer air duct;

wherein an outer wall of the firebox is provided with an air outlet communicated with the interlayer air duct;

wherein a bottom portion and a top portion of an inner wall of the firebox are respectively provided with bottom air intake holes and top air intake holes communicated with the interlayer air duct;

wherein inner walls of the top air intake holes are formed into an upwardly guided semi-circular shape;

wherein the interlayer air duct is provided with a spiral air guide vane sealed to duct wall surfaces to form a spiral ventilation path;

wherein the firebox wall is connected with an auger tube feeder; and wherein an auger box is disposed outside the auger tube feeder in a sealed manner, the auger box having one end sealed to the air outlet of the firebox wall and another end sealed to a single air supply fan, such that air supplied by the single air supply fan is delivered both to the interlayer air duct for combustion and to the auger tube feeder for cooling.

2. The firebox according to claim 1, wherein the firebox bottom plate includes a fixed part and a movable part, in which the fixed part and the movable part are rotatably mounted, and the fixed part is fixedly mounted on the inner wall of the firebox; a rotating shaft outside the firebox passes through the firebox wall and is connected to the movable part, and the movable part is turned between 0-90° by rotating the rotating shaft.

3. The firebox according to claim 2, wherein the rotating shaft is connected with a handle, or the rotating shaft is connected with a motor and driven by the motor.

4. The firebox according to claim 2, wherein the fixed part is a circular sheet structure or a circular ring structure, and the movable part is fitted in the fixed part and is rotatably connected to the fixed part.

5. The firebox according to claim 3, wherein the auger tube feeder has a feed port, and a feeding motor can transport charcoal or wood to the firebox bottom plate through the feed port.

6. The firebox according to claim 5, wherein a detachable ash box is placed under the firebox bottom plate.

7. The firebox according to claim 6, wherein the ash box is in a shape of cylinder or square drawer.

8. The firebox according to claim 1, wherein the auger tube feeder has a feed port, and a feeding motor can transport charcoal or wood to the firebox bottom plate through the feed port.

9. The firebox according to claim 2, wherein the auger tube feeder has a feed port, and a feeding motor can transport charcoal or wood to the firebox bottom plate through the feed port.

10. The firebox according to claim 8, wherein a detachable ash box is placed under the firebox bottom plate.

11. The firebox according to claim 9, wherein a detachable ash box is placed under the firebox bottom plate.

12. The firebox according to claim 10, wherein the ash box is in a shape of cylinder or square drawer.

13. The firebox according to claim 11, wherein the ash box is in a shape of cylinder or square drawer.

* * * * *